US006269512B1

(12) United States Patent
Thomson et al.

(10) Patent No.: US 6,269,512 B1
(45) Date of Patent: Aug. 7, 2001

(54) GRIP WASHER

(76) Inventors: Dearl Thomson, 4574 Tenby Chase, Loves Park, IL (US) 61111; Dale Thorstens, 1319 Widergren Dr., Rockford, IL (US) 61108; Donn Woodworth, 3360 Cornelia Ave., Rockford, IL (US) 61102

( * ) Notice: Subject to any disclaimer, the term of this patent is extended or adjusted under 35 U.S.C. 154(b) by 0 days.

(21) Appl. No.: 09/378,329

(22) Filed: Aug. 20, 1999

Related U.S. Application Data

(60) Provisional application No. 60/097,173, filed on Aug. 20, 1998.

(51) Int. Cl.[7] ..... A46B 9/02; A47L 25/00

(52) U.S. Cl. ..... 15/104.92; 15/104.94; 15/88.1; 15/160

(58) Field of Search ..... 15/21.2, 88.1, 15/97.1, 104.92, 104.94, 160

(56) References Cited

U.S. PATENT DOCUMENTS

| | | | | |
|---|---|---|---|---|
| 3,224,029 | * | 12/1965 | Domingos . | |
| 3,608,120 | * | 9/1971 | Seiler | 15/97.1 |
| 4,380,839 | | 4/1983 | Caradonna . | |
| 4,473,917 | * | 10/1984 | Britton | 15/160 |
| 4,554,696 | | 11/1985 | Nye, Jr. . | |
| 4,734,952 | | 4/1988 | Parchment et al. . | |
| 4,750,230 | | 6/1988 | Osborn . | |
| 4,821,358 | | 4/1989 | Wyckoff et al. . | |
| 4,897,892 | | 2/1990 | Bubien . | |
| 4,944,063 | | 7/1990 | Jordan . | |
| 4,946,510 | | 8/1990 | Kinnebrew, II et al. . | |
| 4,953,999 | | 9/1990 | Rivers . | |
| 5,094,557 | | 3/1992 | Nelson et al. . | |
| 5,269,615 | | 12/1993 | Lewis, Jr. . | |
| 5,664,277 | | 9/1997 | Matlock . | |

FOREIGN PATENT DOCUMENTS

| | | | | |
|---|---|---|---|---|
| 1 183 885 | * | 12/1964 | (DE) | 15/160 |

* cited by examiner

*Primary Examiner*—Randall E. Chin
(74) *Attorney, Agent, or Firm*—Keith Frantz

(57) ABSTRACT

A grip washer includes a tubular body having a closed lower end for holding cleaning fluid and an open upper end for receiving the grips or handles to be cleaned. A helical cleaning brush with multiple turns for cleaning the grips is threaded into position in the body. A second helical brush of a single turn threaded into the body and spaced above the cleaning brush provides a splash guard function during grip cleaning.

12 Claims, 4 Drawing Sheets

GRIP WASHER

This application claims benefit to Provisional Application 60/097,173 filed Aug. 20, 1998.

BACKGROUND OF THE INVENTION

1. Field of Invention

The present invention relates generally to cleaning apparatus, and more particularly, to apparatus adapted for cleaning of handles and grips of golf clubs and like items.

2. Description of Prior Art

As is well known, the gripping portions of golf clubs, tennis rackets, and like items become sticky, greasy and generally dirty after use and over a period of time. Some golf enthusiasts even suggest that their golf game is affected by a dirty grip (see e.g., Matlock, U.S. Pat. No. 5,664,277). Thus, there is a recognized need for grip and handle washers, and there are multiple prior patents disclosing a variety of prior grip washer arrangements.

However, the prior grip washers tend to be relatively complicated, and correspondingly, relatively expensive.

For example, grip washers with motorized brushes for cleaning grips and handles are disclosed in Nye, Jr., U.S. Pat. No. 4,554,696; Osborn, U.S. Pat. No. 4,750,230; and Bubien, U.S. Pat. No. 4,897,892.

Other rather complicated grip washer arrangements are disclosed in Caradonna, U.S. Pat. No. 4,380,839; Kinnebrew, et al., U.S. Pat. No. 4,946,510.

One relatively recent prior patent recognizing and attempting to solve many of the difficulties of complexity and expense associated with other prior grip washers is Matlock U.S. Pat. No. 5,664,277. Briefly, Matlock discloses a tubular grip washer with sets of stacked radial brushes and spacers for cleaning grips and handles. Unfortunately, however, although Matlock resolves some of the issues of other prior grip washers, the Matlock grip washer is still relatively complicated and expensive in the multitude of stacked parts required, and does not lend itself to ease of assembly or disassembly for cleaning and/or brush replacement purposes.

Thus, it is clear the need for a simple and relatively inexpensive, yet effective grip washer remains unfulfilled by prior grip washers.

SUMMARY OF THE INVENTION

The general aim of the present invention is to provide a new and improved grip washer comprising relatively few parts, which is easily assembled and disassembled for cleaning and part replacement purposes, and which is readily adapted for a variety of modified embodiments.

Briefly, a preferred grip washer includes a tubular body having a closed lower end for holding cleaning fluid and an open upper end for receiving the grips or handles to be cleaned longitudinally therein. Cleaning is effected by a single helical brush with multiple turns that is simply threaded into position in the body. A splash guard is also provided, such as a second helical brush of a single turn threaded into the body and spaced above the cleaning brush. A cap may optionally be provided to close the top of the grip washer when not in use or for transportation from one place to another. The simple tubular construction enables the grip washer adapted for use as a mobile unit, or to be used with a base for a free-standing unit.

Figure 1:
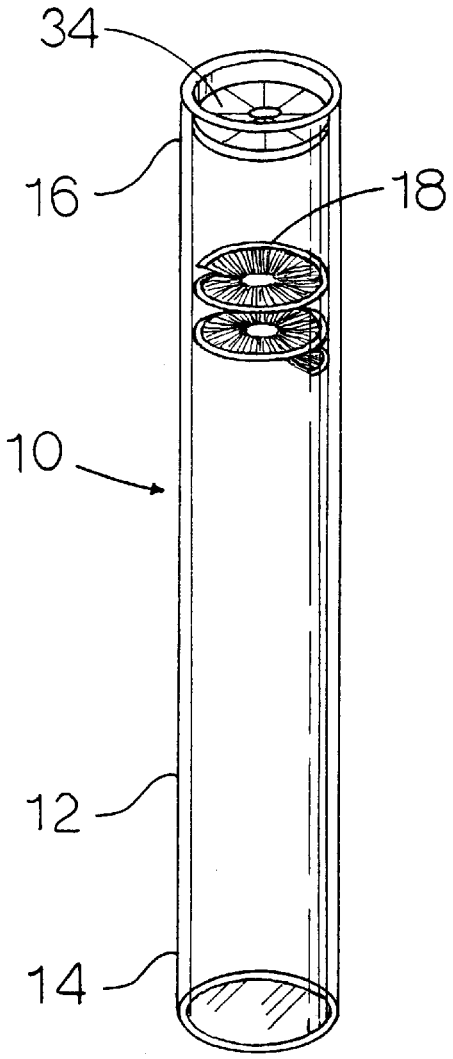
FIG. 1 is a perspective view of a new and improved grip washer incorporating the unique aspects of the present invention.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE INVENTION

Figure 2:
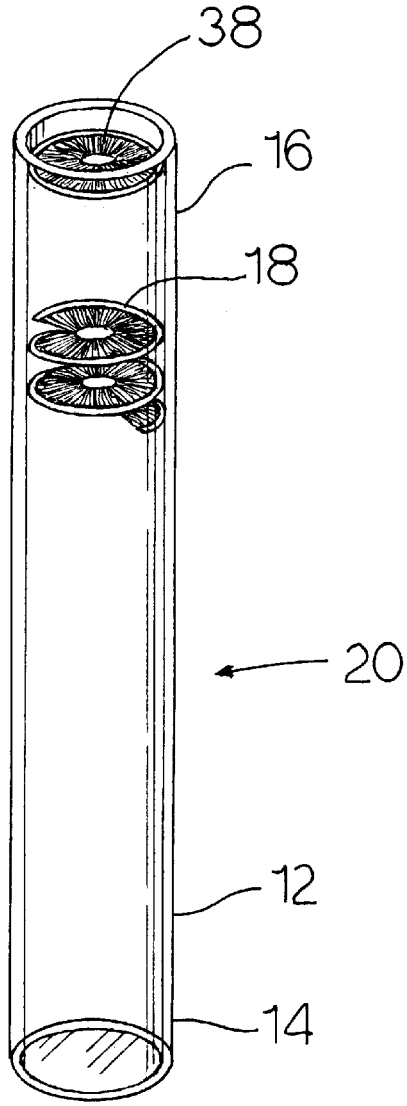
FIG. 2 is a perspective view of a alternate embodiment of the invention.
Figure 3:
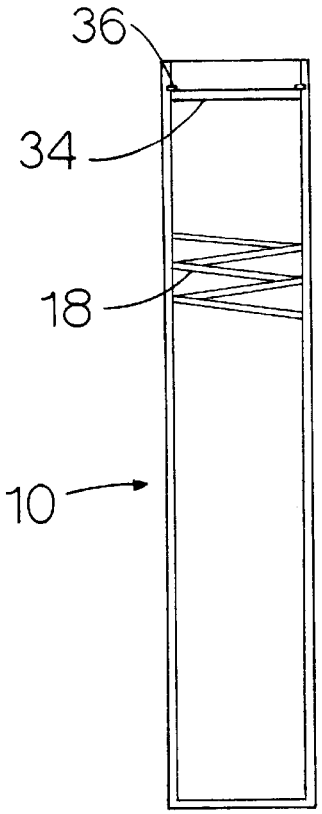
FIGS. 3 and 4 are plan views of the grip washers of FIGS. 1 and 2, respectively.
Figure 4:
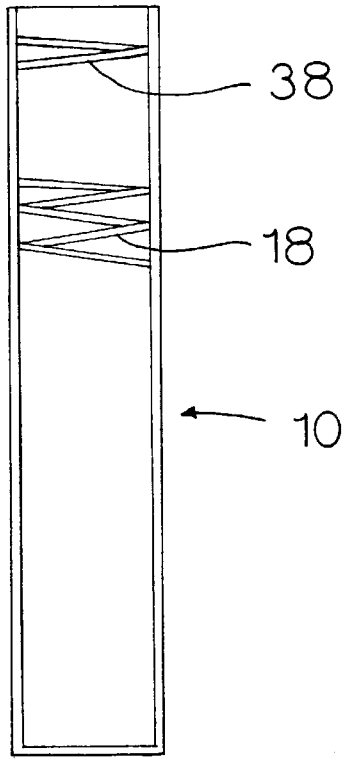
Figure 5:
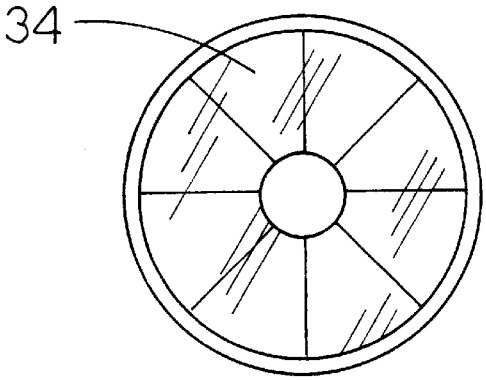
FIGS. 5 and 6 are top views of the grip washers of FIGS. 1 and 2, respectively.
Figure 6:
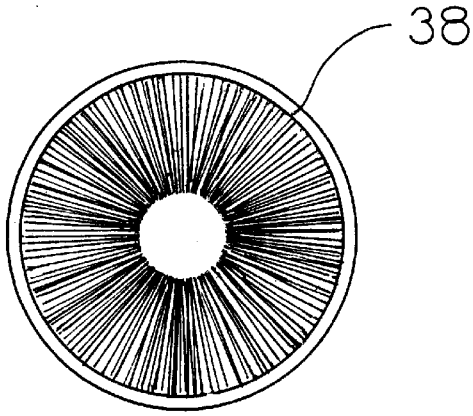

For purposes of illustration, alternate embodiments of the present invention are shown in the drawings as grip washers 10 and 20 of FIGS. 1 and 2, respectively; front views being shown in FIGS. 3 and 4, respectively; and top views being shown in FIGS. 5 and 6, respectively. These and other alternate embodiments shown in the drawings and discussed herein share many common features and apparatus which are discussed generally in connection with the grip washer 10 embodiment of FIG. 1, it being understood that such discussion generally applies to all embodiments shown and contemplated within the scope of the invention, with the differences between the embodiments shown being particularly pointed out.

Briefly, the grip washer 10 includes an elongated body 12 with a closed lower end 14 and an open upper end 16. One or more cleaning brushes such as brush 18 are positioned in the body approximately two-thirds to three-fourths the way up from the bottom. The brushes are generally circular and of a type with a center hole for receiving a handle 24 or grip of, for example, A golf club, tennis racket, baseball bat, racket ball racket, ski pole, fishing pole, and similar items having an elongated handle or grip for cleaning thereof.

Figure 9:
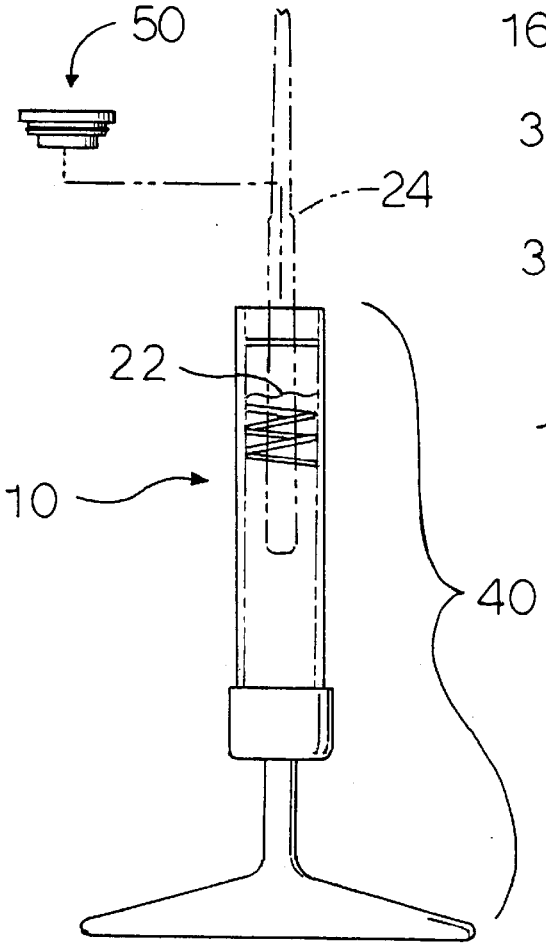
FIG. 9 is a plan view of the embodiment of FIG. 8 and showing a cap removed from the grip washer and a typical handle in dashed lines including a grip as positioned in the grip washer.

During use, the grip washer 10 is filled with cleaning fluid 22 to a level at approximately the top of the brush 18 (see FIG. 9), and the handle 24 to be cleaned is inserted downwardly through the open upper end 16 and through the center of the brush, after which the handle is scrubbed with a combination of up-and-down and spinning movement, as desired.

In accordance with the present invention, the grip washer 10 is of relatively simple construction, adapted to provide splash-free cleaning of handles and grips, and that can be easily adapted for free-standing or mobile use. As a result, the grip washer provides a convenient and relatively inexpensive means for washing handles and grips.

More specifically, the preferred embodiments includes a helical brush 18 for cleaning handles and grips, and a splash guard to prevent splashing of the cleaning fluid 22 during use.

Figure 11:
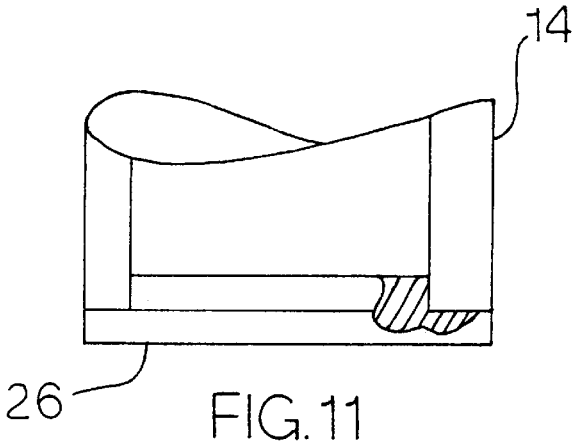

In carrying out the invention, the body 12 is of relatively simple construction, and adapted for ease of installation of the helical brush 18 and splash guard. To this end, the body is preferably formed from a single piece of thick tubing of material suitable for adhesive connection with parts of similar material such as PVC and other plastics, and the closed lower end of the body comprises a cap 26 of such similar material glued into the lower end of the tube for a water-tight seal. The construction of one such suitable embodiment is illustrated in FIG. 11. It is evident, however, that the lower cap may take alternate forms within the scope of the present invention.

Figure 10:
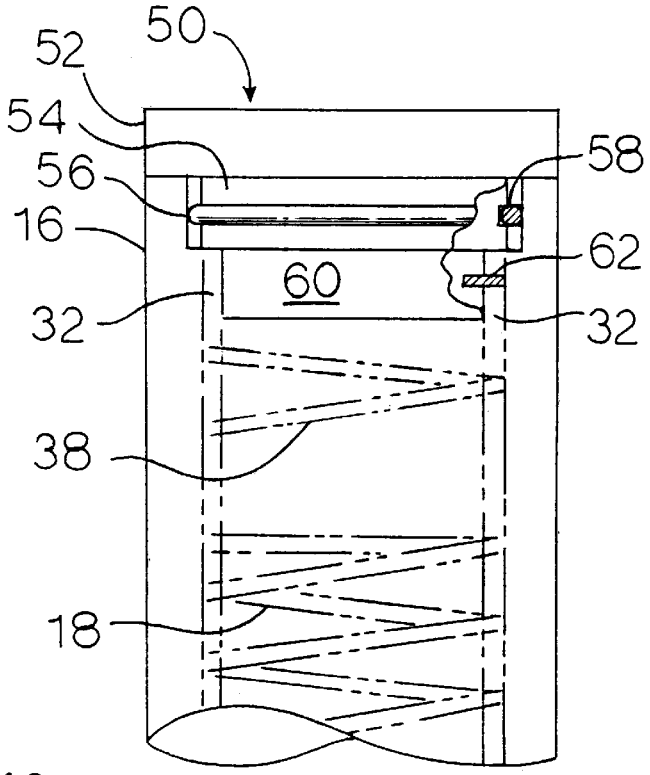
FIGS. 10 and 11 are enlarged fragmentary views of the upper and lower ends, respectively illustrating certain details of the present invention.

The preferred brush 18 is a single helical brush with multiple turns, and includes radially extending bristles and a helical outer casing holding the bristles in place. In this instance, the inside diameter of the body 12 is formed with internal threads 32 for simply threading the brush, and more particularly the outer casing, downwardly into the body. As best seen in FIG. 10, the internal threads extend downwardly from the upper end of the body, to a depth suitable for threading the brush to a position with its upper turn at approximately one-fourth the way down from the top of the body. Advantageously, the helical brush provides multiple turns for effectively simulating many brushes in a relatively compact length, and although the brush shown includes three turns, it is evident that a brush with additional turns may be provided for in the grip washer 10.

In further carrying out preferred embodiments of the invention, the splash guard is positioned in the body 12 above the brush 18 to prevent the cleaning fluid 22 from splashing out during use of the grip washer 10. The splash guard may take any convenient form, adapted for retention in the body, to allow the handle to pass through to the brush, and to prevent splashing of the cleaning fluid as the handle is cleaned. In the grip washer 10, the splash guard 34 is a castilated rubber guard having an outer ring such that the guard is held in place with a retaining ring 36 releasably inserted into an annular groove in the tube, or otherwise secured in the tube above the brush. In the grip washer 20, the splash guard comprises a second helical brush 38 of a single turn that is simply threaded into the threads 32 in the body 12, and spaced above the cleaning brush 18.

Advantageously, releasable connection of the splash guard 34, and the threaded installation of the splash guard 38 and the cleaning brush 18, permit removal of same with relative ease in the event a thorough cleaning of the body is desired, or for cleaning and/or replacement of the splash guard or cleaning brush.

Figure 7:
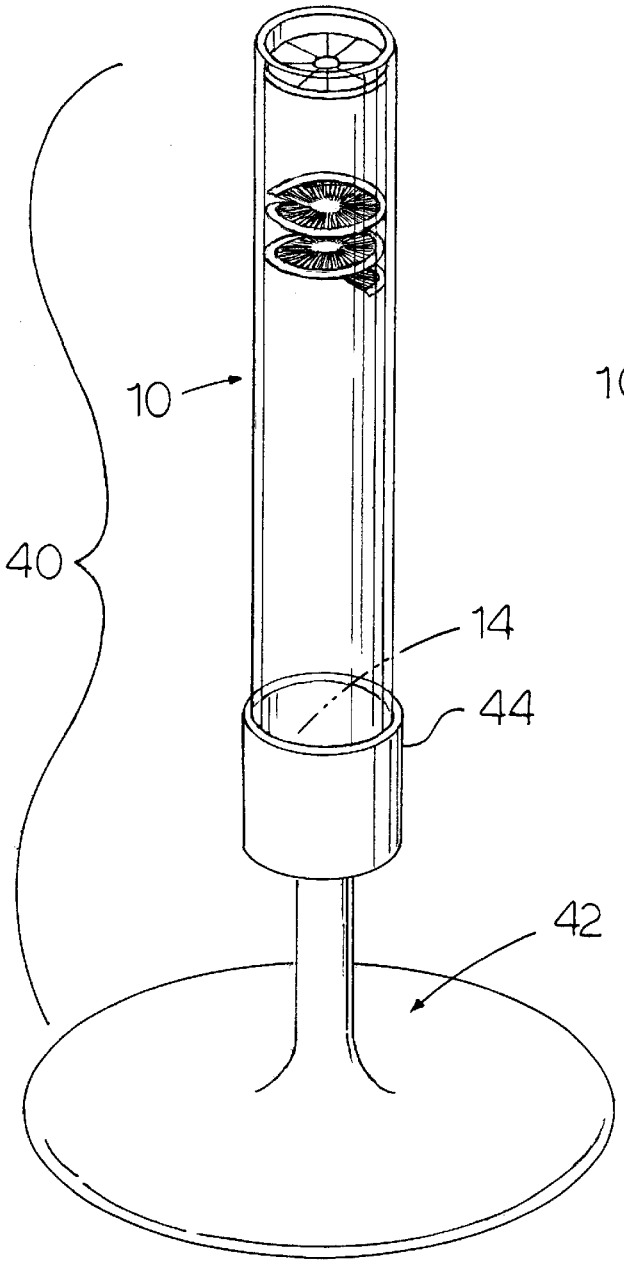
FIGS. 7 and 8 are perspective views of second and third alternate embodiments of the present invention.
Figure 8:
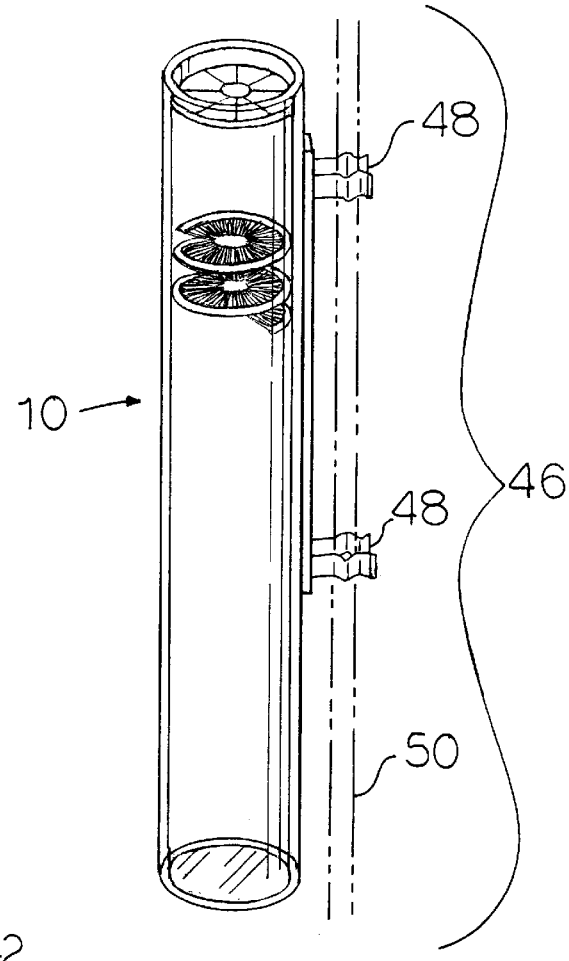

For illustrative purposes, two additional alternate embodiment grip washers are shown in FIGS. 7 and 8. FIG. 7 illustrates a grip washer 10 generally as described above, but with a base 42 to comprise a free-standing unit 40. In this instance, the base includes an upper cup portion 44 for slidably receiving the lower end portion 14 of the grip washer 10. The grip washer 46 shown in FIG. 8 includes a pair of vertically spaced spring clamps 48 for releasable connection to a pole member 50 such as to a stationary pole or a mobile pole such as may be positioned on the side or back of a golf cart (not shown) to provide for a mobile grip washer. Advantageously, the grip washer 46 of FIG. 8 may also be inserted into the free-standing base 42 illustrated in FIG. 7. In addition, it is evident that alternate connection means may be used for connection of the grip washer 10 for providing either or both a free-standing and mobile unit.

In preferred embodiments, a cap is optionally provided for the upper end 16 of the grip washer body 12, to provide for spill-free transportation and storage of the grip washer when not in use. The details of a preferred cap 50 is shown in FIG. 10. In this instance, the cap includes an upper diameter portion 52 for gripping, to assist in installation and removal of the cap from the open end 16 of the body 12, and a center diameter portion 54 provided with a radial o-ring 56 for sealing in a counter bore 58 formed at the top of the tube, the counter bore being at least as large as the major diameter of the internal threads 32 to permit installation of the brush 18 and splash guard 38. The cap also includes a lower diameter portion 60 sized for a slip fit within the minor diameter of the internal threads 32, and a pin 62 extending radially therefrom and positioned and sized for threading into the threads to secure the cap in position. Alternate caps may also be provided, such as, for example, a pliable, molded vinyl cap (not shown) simply slips over and seals against the top of the grip washer, or a hard plastic cap sized to slip over the top of the grip washer and provided with a radial o-ring for sealing against either the top edge or outside diameter of the upper portion of the body.

From the foregoing, it will be apparent that the present invention brings to the art a new and improved grip washer which, (1) by virtue of providing an internally threaded body and helical cleaning brush, is of relatively simple construction, and thus relatively inexpensive as compared with prior grip washers, (2) by virtue of a splash guard, provides for splash-free cleaning of grips and handles, and (3) is easily disassembled and reassembled for cleaning and part replacement purposes.

We claim:

1. A grip washer comprising:

a tubular body having a closed lower end and an open upper end portion, said body further having internal threads formed therein extending from the upper end portion; and a helical brush threaded into said internal threads in said body though said open end.

2. A grip washer as defined in claim 1 further comprising a splash guard positioned in said open upper end.

3. A grip washer as defined in claim 2 in which said splash guard comprises a second helical brush threaded into said internal threads in said body and spaced above said first helical brush.

4. A grip washer as defined in claim 1 further comprising a cap adapted to thread into said internal threads for closing the open upper end of said body.

5. A grip washer as defined in claim 4 in which said cap includes a pin positioned and sized for threading into said internal threads.

6. A grip washer as defined in claim 1 in which said brush includes radially extending bristles.

7. A grip washer comprising:

a tubular body having a closed lower end and an open upper end, and having internal threads formed therein; and a helical brush threaded into said internal threads in said body and positioned for receiving a grip inserted through said open upper end.

8. A grip washer as defined in claim 7 further comprising a splash guard positioned in said open upper end above said first helical brush.

9. A grip washer as defined in claim 8 in which said splash guard comprises a second helical brush threaded into said internal threads in said body.

10. A grip washer as defined in claim 7 further comprising a cap adapted to thread into said internal threads for closing the open upper end of said body.

11. A grip washer as defined in claim 10 in which said cap includes a radially extending pin positioned and sized for threading into said internal threads.

12. A grip washer as defined in claim 7 in which said brush includes radially extending bristles.

* * * * *